US006209769B1

(12) United States Patent
Seals et al.

(10) Patent No.: US 6,209,769 B1
(45) Date of Patent: Apr. 3, 2001

(54) SIDE PACK

(75) Inventors: Peggy Newgarden Seals, Berkeley; Carla M. Talbot, Vallejo, both of CA (US)

(73) Assignee: Peggy Newgarden-Seals, Berkeley, CA (US); by said Carla M. Talbot ( * ) Notice: Subject to any disclaimer, the term of this patent is extended or adjusted under 35 U.S.C. 154(b) by 0 days.

(21) Appl. No.: 08/762,886

(22) Filed: Dec. 7, 1996

(51) Int. Cl.[7] ..... A45F 5/00

(52) U.S. Cl. ..... 224/583; 224/675; 224/607; 224/610; 224/664; 224/683

(58) Field of Search ..... 224/674, 675, 224/676, 677, 680, 235, 236, 603, 604, 605, 607, 613, 614, 616, 617, 625, 626, 627, 637, 638, 639, 645, 650, 652, 654, 655, 658, 581, 582, 583, 911; D3/215, 216, 217, 218, 226, 227

(56) References Cited

U.S. PATENT DOCUMENTS

| | | | | |
|---|---|---|---|---|
| D. 252,355 | | 7/1979 | Uber . | |
| 268,932 | * | 12/1882 | Poirier | 224/639 |
| D. 316,999 | | 5/1991 | Sarff . | |
| D. 343,291 | | 1/1994 | Langford . | |
| D. 354,619 | * | 1/1995 | Soukeras | D3/217 |
| D. 358,705 | * | 5/1995 | Saggese, Jr. | D3/215 |
| D. 370,776 | | 6/1996 | Frey . | |
| D. 373,018 | | 8/1996 | Alberti . | |
| 1,416,238 | * | 5/1922 | Seiler | 224/683 |
| 2,324,194 | * | 7/1943 | Campiglia | 224/236 |
| 3,674,188 | * | 7/1972 | Anderson | 224/603 |
| 3,938,716 | * | 2/1976 | Jackson et al. | D3/217 |
| 3,949,916 | * | 4/1976 | Yount | 224/675 |
| 4,580,707 | * | 4/1986 | Shoemaker | 224/911 |
| 4,796,790 | * | 1/1989 | Hamilton | 224/675 |
| 4,801,059 | * | 1/1989 | Hayes | 224/236 |
| 4,878,606 | | 11/1989 | Miller . | |
| 4,903,874 | * | 2/1990 | Shoemaker | 224/911 |
| 5,285,833 | | 2/1994 | Haxby . | |
| 5,292,042 | * | 3/1994 | Yamaguchi et al. | 224/617 |
| 5,398,855 | | 3/1995 | Schaiewitz . | |
| 5,445,303 | * | 8/1995 | Cawile, Jr. | 224/677 |
| 5,465,889 | | 11/1995 | Smith . | |

FOREIGN PATENT DOCUMENTS

| | | | | |
|---|---|---|---|---|
| 57338 | * | 2/1940 | (DK) | 224/209 |
| 596839 | * | 5/1994 | (EP) | 224/254 |
| 881174 | * | 4/1943 | (FR) | 224/215 |

OTHER PUBLICATIONS

Lillian Vernon Corp., Lillian Vernon Catalogue, 1996, vol. 610, p. 83, item 537 amd 538, pub. Virginia Beach Virginia, U.S.A.

* cited by examiner

*Primary Examiner*—Gregory M. Vidovich
(74) *Attorney, Agent, or Firm*—Brian Beverly

(57) ABSTRACT

An improved side pack for holding objects on the side of the torso to provide comfortable, ready, and ergonomic access to the objects, comprising a strap assembly and a suspended bag. A bag includes a main compartment facing away from the user having a closing flap for closing a top opening of the compartment. Secondary compartments are provided facing the user. A hold-down depending from the secondary compartments may be attached to a belt loop to restrict movement of the bag. A strap assembly comprises a primary strap adjustably attached to retention straps on the bag. The primary strap has a wide midportion for spreading the weight of the bag. An auxiliary strap attachable to a plurality of positions on the midportion of the primary step extends across the back and under the distal arm and serves to retain the primary strap in place on the shoulder.

12 Claims, 4 Drawing Sheets

SIDE PACK

BACKGROUND

This invention relates to a side pack to be worn by a user to provide secure, comfortable and ergonomic access to the contents of the side pack. In particular, the invention provides a small side pack for objects, such as a cellular telephone or camera, which affords ready and ergonomic access to the object at the side of the user's torso. The invention is further adapted to include a shoulder strap and to retain the shoulder strap on the user's shoulder with an auxiliary strap extending transversely across the upper torso and beneath the user's distal arm. The invention includes retention straps for connecting the compartment portion of the side pack to the shoulder strap and which are also adapted to allow the compartment portion to be attached directly to a waist belt. The compartment portion thus can be placed at the user's side or waist or on the user's hips either by using the shoulder strap or by suspending it directly from a belt.

DESCRIPTION OF THE PRIOR ART

The most essential and routinely accessed objects by a person while away from home may be a wallet, checkbook, a pen or pencil, and the increasingly ubiquitous cellular telephone. The necessities for more extended travel or touring may include a wallet, traveler's checks, passport, map, a pen or pencil, and a camera. When traveling lightly, carrying only the bare essentials such as these, it is cumbersome to use a large pack such as a briefcase or sizeable purse. Smaller bags, while conveniently sized and easier to carry, merely provide compact retention of their contents.

Common object holders, be they hand bags, clutches, or brief cases, pose further problems. They can easily become separated from the user because the user frequently removes the pack when slitting, and must remember to retrieve it when moving on. A variation of this problem is presented by cellular telephone cases which protect the cellular telephone, but do not encourage the user to return the telephone to a pack worn on the user's body. There is no generally accepted convenient place to keep a cellular telephone on one's person. The telephone generally is put in a shirt or coat pocket not designed for such a bulky item, or on an adjacent table or chair. Sometimes the cellular telephone is forgotten and left behind. Many cellular telephone cases provide a loop on the back of the case for carrying the case on the user's waist belt. This requires the user to thread the waist belt through the loop—a tedious task usually skipped. Simply put, cases provided for enclosing cellular telephones do not encourage the user to keep the telephone on the user's person.

Access to essential objects is an issue of convenience and efficiency. Virtually instant access becomes important for the cellular telephone user who has just been called. Unnecessary effort spent opening a briefcase, unzipping a purse, or loosening snaps reduces efficiency and lowers convenience of use of the object being retrieved.

Packs or purses hung loosely from a shoulder strap must be constantly monitored and adjusted to keep them in place, thus diverting use of the hands from other tasks. Shoulder straps are normally worn over the shoulder on the same side of the body on which the pack or purse is suspended. The movement of walking causes a pack hung from the shoulder to swing away from the body, pulling the shoulder strap in the direction of the swing and gradually working the strap off the shoulder. The lighter the pack, the more likely the shoulder strap is to slip off the shoulder. Further, with each outward swing comes a return collision with the user thus diverting attention to controlling the position of the pack on the user's body. Monitoring of the strap and the suspended pack diverts attention, reduces freedom of the hands, and hampers walking. The continual collisions with the pack and constant hiking of the shoulder strap back up on the shoulder are annoyances. Finally, after extended wear, many shoulder straps cut into the user's neck and shoulder and become uncomfortable to wear.

Most packs used for carrying personal items are worn over outer layers of clothing, and must be taken off whenever the outer layer of clothing is removed, such as when taking off a coat. The user must later remember where the pack is and retrieve it. Especially for more extended traveling or while touring, failure to retrieve one's pack containing personal belongings or leaving it exposed to theft can lead to difficulties and significant distress.

It is therefore an object of the invention to provide a side pack for wearing by a user which offers secure, comfortable and ergonomic access to the contents of the side pack. It is a further objective of the invention to provide a side pack sized to hold a cellular telephone or small camera and adapted to fit comfortably on the side of the torso. It is a still further objective of the invention to provide a side pack to be worn on the user's body affording secure retention of and quick and ergonomic access to a cellular telephone or camera. It is yet a further objective of the invention to provide a side pack having a shoulder strap which is comfortably retained in place on the shoulder by a secondary strap. It is another objective of the invention to provide a side pack suspended from a shoulder strap having a wide midportion allowing the strap to be worn comfortably over the shoulder. It is also an objective of the invention to provide a side pack to be worn suspended from a shoulder strap having a hold-down means which may be attached to a belt loop to prevent the side pack from swinging away from and back against the use while walking. It is an additional objective of the invention to provide a side pack having a strap assembly which can be adapted to allow wearing of the side pack over the shoulder, around the waist or on the hip, at the user's option.

SUMMARY OF THE INVENTION

A side pack according to the invention includes a compartment and shoulder strap assembly. The side pack is sized to fit unobtrusively and comfortably at one's side, either above the waist, or at the waist or hips. The side pack comprises a main compartment facing away from the user sized to receive a cellular telephone or other object of like dimensions, such as a small camera. A top closing flap opens and closes over the top opening of the main compartment. The end of the flap is detachably sealed over the opening using a quickly opening fastener, such as Velcro® hook-and-loop-type fastener, to provide instant and easy access to the contents of the main compartment.

The side pack includes a plurality of additional compartments separate from the main compartment facing towards the user sized generally to accept thinner items such as a wallet, credit cards, papers, a passport, maps, or a pen or pencil. The additional compartments are open at the top to allow the user to slip items in and out of them with ease. A key clip may depend from the outermost of the additional compartments and may be attached to a belt loop for holding the bag to the user's body, or it may be used to hold a ring of keys or other objects. The top of the side pack has two opposing waist belt retention straps having conventional fastening means, e.g., snaps, for fastening the straps into loops capable of accepting a waist belt. The side pack can thus be hung on a waist belt at the user's election. A stretchable band may also be affixed to the end of each waist belt retention strap.

A shoulder strap assembly is attached to the bag for hanging the side pack on a shoulder. Each end of the shoulder strap assembly is attached demountably to the waist belt retention strap or to the stretchable band at the user's option depending on the length and elasticity preferred by the user. The shoulder strap and attached waist belt retention straps form a harness which is adjustable in length. The harness may be used to wear the side pack over the shoulder or, at the user's election, around the waist. The shoulder strap is widened through its middle portion where it rests on the shoulder to distribute the weight of the bag over a larger area for increased comfort. An elastic secondary strap is attached to the middle portion of the shoulder strap and loops transversely across the upper torso and under the distal arm. The secondary strap holds the shoulder strap in placed, preventing it from slipping off the user's shoulder. The strap assembly, especially if the hold-down is attached to a belt loop, maintains the side pack comfortably at the user's side, providing virtually instant access to the objects held, and freeing the user's hands from managing the side pack and strap. The distribution of weight by the wide midportion of the shoulder strap, the comfortable placement of the side pack on the side of the body, the retention of the shoulder strap in place by the secondary strap, and the relatively small size of the side pack all work together to allow the user to wear the side pack for extended periods of time and encourage the user to return items to the pack after use.

DESCRIPTION OF THE ILLUSTRATED EMBODIMENT

Figure 1:
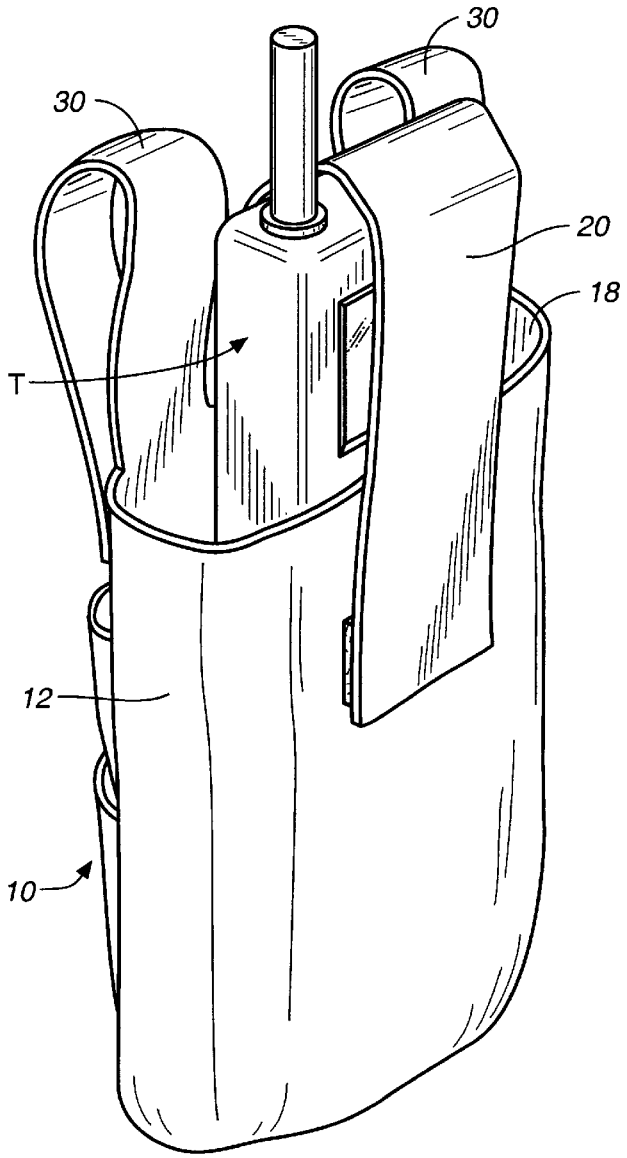
FIG. 1 is a perspective view of a side pack in accordance with the invention showing a cellular telephone in the side pack.
Figure 2:
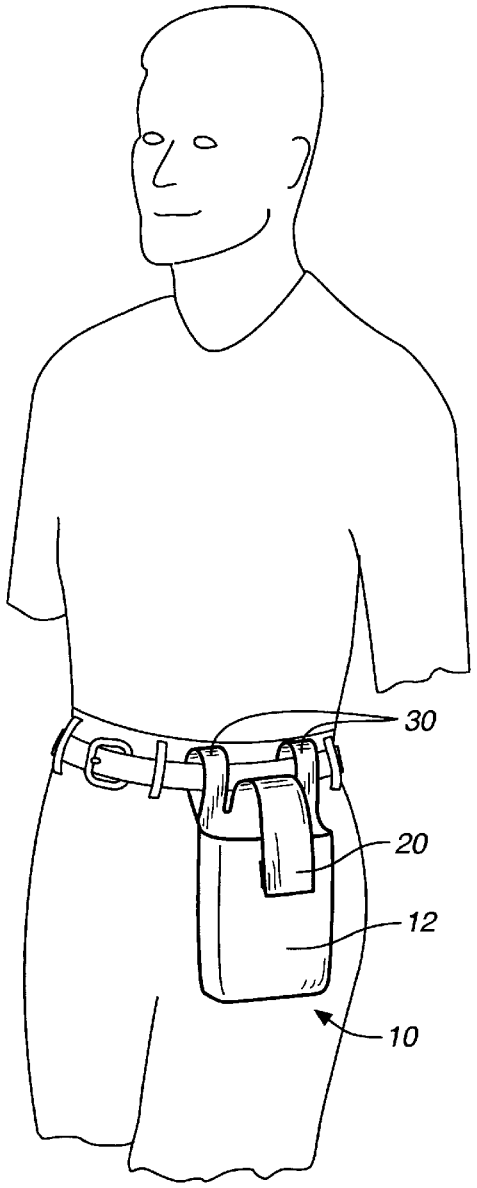
FIG. 2 is a frontal perspective view of a side pack in accordance with the invention showing the side pack attached to a waist belt.
Figure 1B:
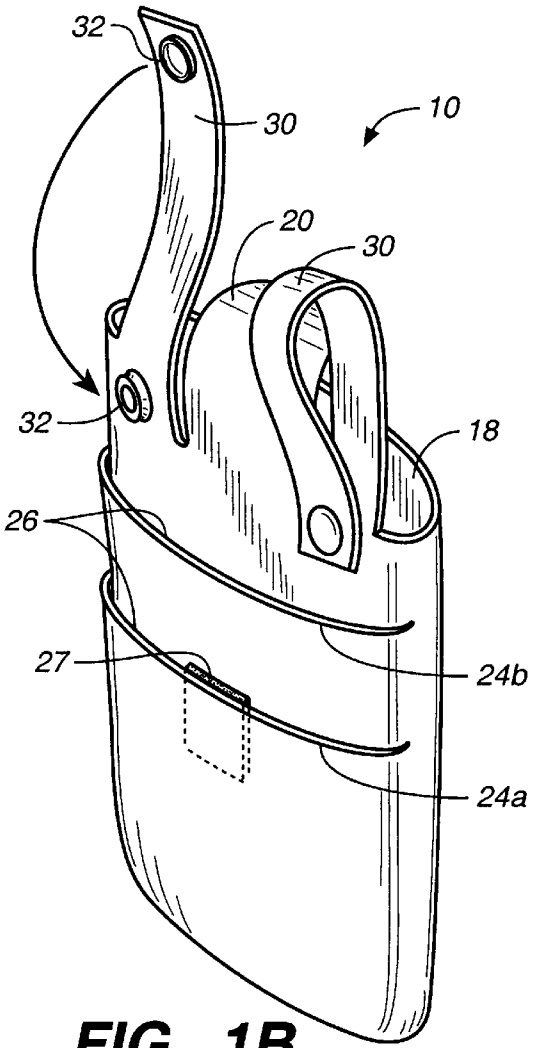
FIG. 1B is a rear perspective view of a side pack in accordance with the invention showing additional compartments which face the user.
Figure 1A:
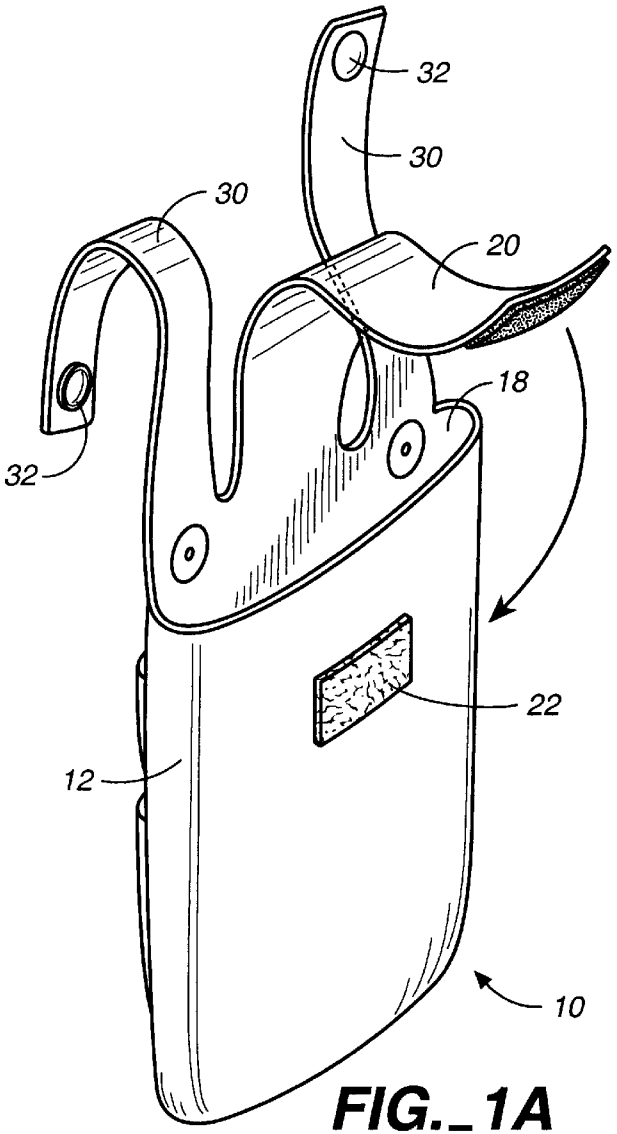
FIG. 1A is a perspective view of a side pack in accordance with the invention including two retention straps and a forwardly extending top closing flap.
Figure 3:
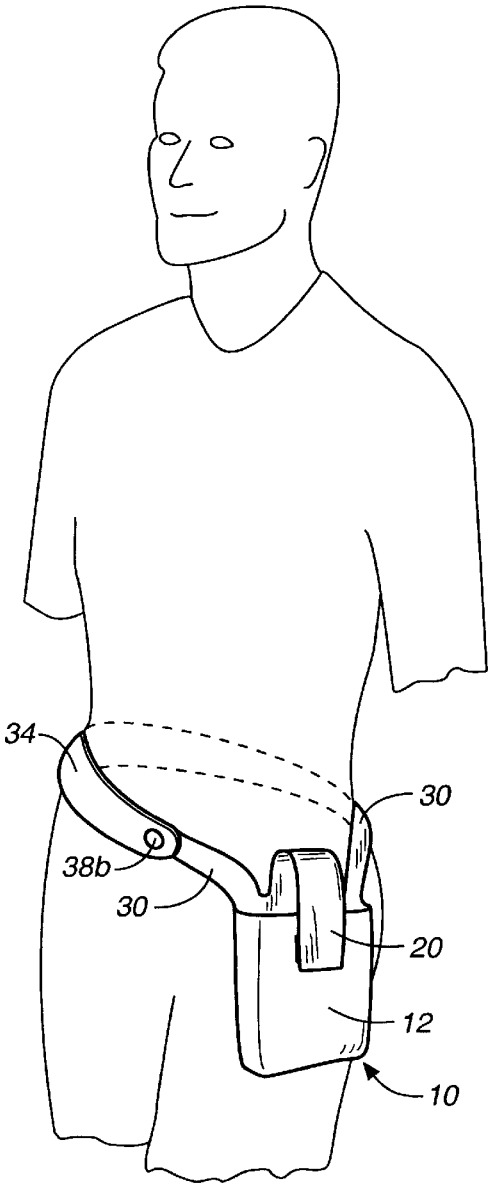
FIG. 3 is a frontal perspective view of a side pack in accordance with the invention showing the side pack suspended at the hips.

A side pack 10 according to the invention comprises a main compartment 12 and a strap assembly 14. The main compartment 12 includes a top opening 18. In the preferred embodiment, the main compartment 12 is sized to hold securely a cellular telephone T. There is enough play in the compartment 12 to allow the user to easily insert the telephone T into the compartment 12 and to quickly retrieve it when needed. The compartment 12 ideally is sized to fit comfortably under the user's arm on the side of the torso. A top closing flap 20 loops over the top opening 18 of the main compartment 12 for securing the contents of the main compartment 12. In the illustrated embodiment seen in FIG. 1A, a quickly opening sealing means 22, such as a Velcro® hook-and-loop-type fastener, is used to demountably seal the top closing flap 20 over the top opening 18. In other preferred embodiments, snaps, magnetic catches, or other quickly opening fasteners could be successfully used so long as quick access to the contents of the main compartment 12 is preserved.

In the preferred embodiment, the main compartment 12 faces away from the user to provide quick access to its contents and secondary compartments 24*a* and 24*b* are provided which face the user. The secondary compartments 24*a* and 24*b* are preferably size to accept flatter objects such as a wallet, maps, a passport, checkbook, or merely a pen or pencil. In the illustrated embodiment shown in FIG. 1B, the secondary compartments 24*a* and 24*b* have openings 26 which are not closable except for the force of compression of all the objects in the compartments 12, 24*a* and 24*b*. In another preferred embodiment, closing means 27 could easily be provided for one or all of the secondary compartments.

Although not illustrated, depending from the secondary compartments 24*a* and 24*b* may also be provided a hold-down, such as a key clip. In routine use the hold-down may be attached to a belt loop to restrain swinging motion of the park 10 and for additional security against theft. Alternatively, the hold-down may be used to retain a set of keys.

The main compartment 12 further includes integral retention straps 30, each strap 30 including fastening means 32 allowing the retention straps 30 to be fastened into a closed loop sized to receive a waist belt. The retention straps 30 thus allow the side pack 10 optionally to be worn on the user's belt.

Figure 5:
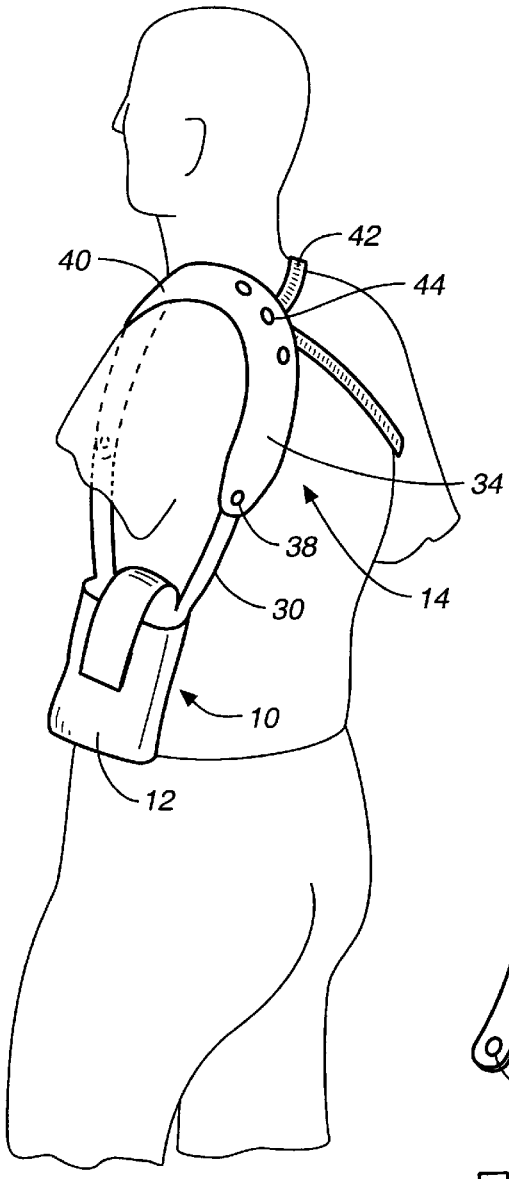
FIG. 5 is a rear perspective view of a side pack in accordance with the invention showing the auxiliary strap extending across the user's back and under the distal arm.
Figure 6:
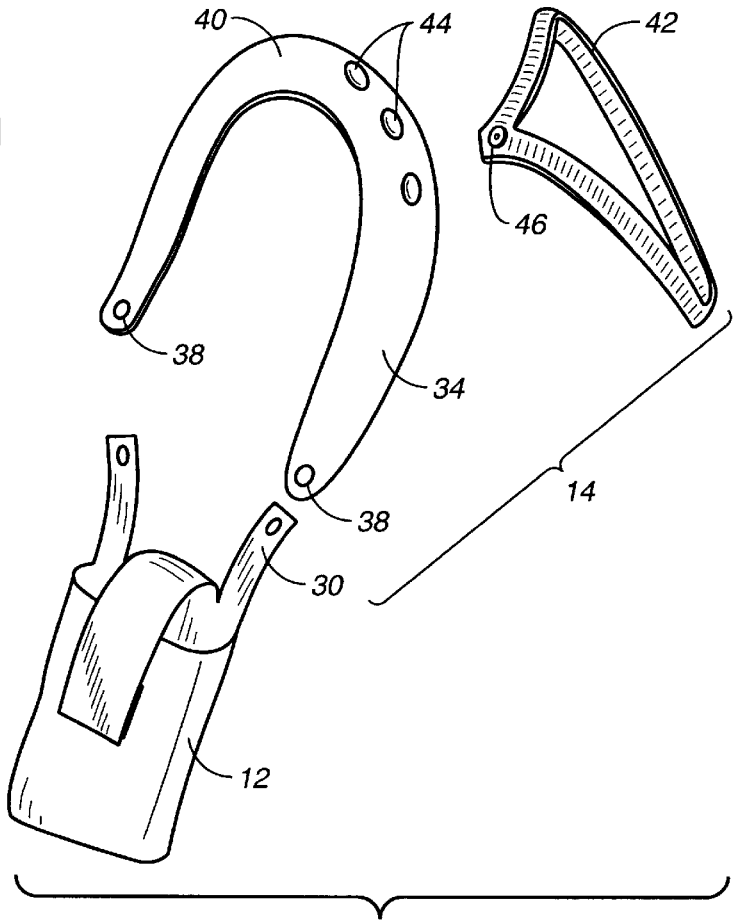
FIG. 6 is an exploded view of a side pack in accordance with the invention.

The strap assembly 14, best seen in FIGS. 5 and 6, is provided for suspending the main compartment 12 from the user's shoulder. The strap assembly 14 comprises a primary strap 34 which, when coupled with the retention straps 30, acts as a shoulder strap or an optional waist harness. The retention straps 30 may also each include a stretchable attachment member, thereby in actual use giving the option of attaching the primary strap 34 to the stretchable attachment members of the retention straps 30 to create a more elastic connection between the main compartment 12 and the primary strap 34. In an alternate embodiment not illustrated, a double bail system is sued to adjustably attach the primary strap 34 to the retention straps 30 to adjust the length between the main compartment 12 and the primary strap 34. However, it can readily be appreciated that other attachment means can be employed to provide a connection between the primary strap 34 and the retention straps 30 of the main compartment 12 which allow adjustments in the length between the main compartment 12 and the primary strap 34.

Figure 4:
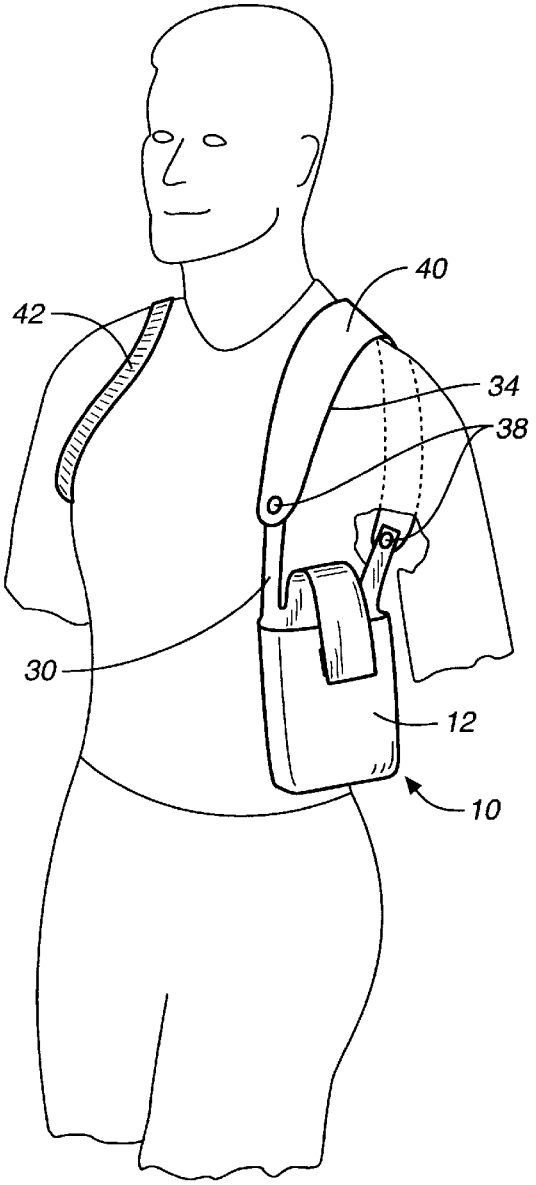
FIG. 4 is a frontal perspective view showing a side pack in accordance with the invention showing the compartment portion at the user's side and the secondary strap extending across the user's torso and under the distal arm.

FIG. 4 shows that the midportion 40 of the primary strap 34 is widened to spread the load of the bag on the user's shoulder for added comfort.

The strap assembly 14 includes an auxiliary strap 42 demountably attached to the midportion 40 of the primary strap 34. As seen in FIGS. 4 and 5, the auxiliary strap 42 extends transversely across the user's upper back and under the user's distal arm. In the preferred embodiment the auxiliary strap 42 is elastic. The attachment of the auxiliary strap 42 to the primary strap 34 maintains the position of the primary strap 34 on the user's shoulder eliminating the need for constantly hiking the primary strap 34 back up onto the shoulder. In the preferred embodiment, a plurality of demountable fasteners 44, e.g., a plurality of the catch portions of a snap are arranged lengthwise along the midportion 40 of the primary strap 34, and the auxiliary strap 42 includes a cooperating fastener 46, e.g., the cooperating portion of a snap, which allows the auxiliary strap 42 to connect to the midportion 40 of the primary strap 34 in a number of positions determined by the locations of the demountable fasteners 44 to best fit the user. Although wearing the side pack 10 with the auxiliary strap 42 has the significant advantage of maintaining the primary strap 34 on the user's shoulder, the auxiliary strap 42 can be detached and the side pack 10 worn without it.

There have thus been described certain preferred embodiments of a side pack. While preferred embodiments have been described and disclosed, it will be recognized by those with skill in the art that modifications are within the true spirit and scope of the invention. The appended claims are intended to cover all such modifications.

What is claimed is:

1. A side pack comprising:

a main compartment including a back panel, means for closing said main compartment, said back panel having a secondary compartment facing the user, said secondary compartment having a top opening, means for closing said secondary compartment, and integral extensions of aid back panel forming a plurality of retention straps, each strap foldable into a rearward-folding loop sized to receive a waist belt, each strap further including means for fastening said strap on to itself to form said loop, each said retention strap including a free end, said main compartment and secondary compartment dimensioned to fit between the plane of the front of the user's abdomen and the plane of the user's back, and a strap assembly comprising a primary strap, said primary strap having two ends, each said end including means for selective attachment of said primary strap to said free end of one of said retention straps, each said end of said primary strap selectively attached to said free end of one of said retention straps, said primary strap and said attached retention straps forming a loop for hanging said compartments from said loop over one of the user's shoulders for comfortable placement of said compartments at the side of the user or about the user's hips or waist.

2. The side pack of claim 1 wherein:

said primary strap includes a wide midpoint having opposite ends and end portions narrower than said midportion extending from said ends of said midportion.

3. The side pack of claim 1 including:

said primary strap having a midportion, and an auxiliary strap demountably attached to said midportion of said primary strap, said auxiliary strap cooperating with said primary strap to retain said primary strap in place on the user's shoulder.

4. The side pack of claim 1 wherein:

said primary strap comprises a midportion, and said strap assembly includes an auxiliary strap demountably attached to said midportion of said primary strap for extending transversely across the user's upper torso and under the distal arm to retain said primary strap in place on the user's shoulder.

5. The side pack of claim 4 wherein:

said auxiliary strap is elastic.

6. The side pack of claim 4 wherein:

said auxiliary strap includes auxiliary strap fastening means for demountably attaching said auxiliary strap to said primary strap, and said primary strap includes a plurality of primary strap fastening means arranged lengthwise along said midportion, for acting in cooperation with said auxiliary strap fastening means for demountably attaching said auxiliary strap to said primary strap in a position defined by the location of one of said primary strap fastening means acting in cooperation with said auxiliary strap fastening means.

7. The side pack of claim 6 wherein:

said auxiliary strap is adjustable in length.

8. The side pack of the claim 4 wherein:

said secondary compartment has a horizontally extending top opening, and said main compartment has a top opening, said means for closing said main compartment comprises a top-closing flap for closing said top opening of said main compartment.

9. The side pack of claim 8 wherein:

said auxiliary strap is elastic.

10. The said pack of claim 8 wherein:

said auxiliary strap includes auxiliary strap fastening means for demountably attaching said auxiliary strap to said primary strap, and said primary strap includes a plurality of primary strap fastening means arranged lengthwise along said midportion, for acting in cooperation with said auxiliary strap fastening means for demountably attaching said auxiliary strap to said primary strap in a position defined by the location of one of said primary strap fastening means acting in cooperation with said auxiliary strap fastening means.

11. The side pack of claim 10 wherein:

said auxiliary strap is adjustable in length.

12. A side pack comprising:

a main compartment including a back panel, an integral extension of said back panel forming a top flap, means for detachably sealing said top flap over said main compartment, said back panel having a plurality of secondary compartments facing the user, said secondary compartments having overlapping, spaced, horizontally extending top openings, means depending from said secondary compartments for holding objects, and an adjustable strap assembly, said adjustable strap assembly comprising:

integral extensions of said back panel forming a plurality of retention straps, each strap foldable into a rearward-folding loop sized to receive a waist belt, each strap further including means for fastening said strap on to itself to form said loop, each said retention strap further having a free end, a primary strap including a wide midportion having opposite ends and two end portions narrower than said midportion extending from said ends of said midportion, each said end portion including means for selective attachment of said primary strap to said free end of one of said retention straps, each said end portion of said primary strap selectively attached to said free end of one of said retention straps, said primary strap and said attached retention straps forming a loop for hanging said compartments from said loop over one of the user's shoulders for comfortable placement of said compartments at the side of the user or about the user's hips or waist, and said strap assembly including an elastic auxiliary strap, adjustable in length, dimensioned to extend transversely across the user's upper torso and under the user's distal arm to retain said primary strap in place on the user's shoulder, and means for demountable attachment of said auxiliary strap to said primary strap, said auxiliary strap demountably attached to said midportion of said primary strap, said main compartment and secondary compartments dimensioned to fit between the plane of the front of the user's abdomen and the plane of the user's back.

* * * * *